United States Patent [19]

Kinoshita et al.

[11] Patent Number: 4,478,192

[45] Date of Patent: Oct. 23, 1984

[54] AIR-FUEL RATIO CONTROL SYSTEM FOR INTERNAL COMBUSTION ENGINES

[75] Inventors: Kenzi Kinoshita; Yukihide Niimi, both of Kariya; Masahiro Urushidani, Toyota; Hidemi Ohnaka, Susono, all of Japan

[73] Assignees: Nippondenso Co., Ltd., Kariya; Toyota Jidosha Kabushiki Kaisha, Toyota, both of Japan

[21] Appl. No.: 459,493

[22] Filed: Jan. 20, 1983

[30] Foreign Application Priority Data

Jan. 21, 1982 [JP] Japan ..... 57-7873

[51] Int. Cl.[3] ..... F02M 51/00

[52] U.S. Cl. ..... 123/489; 123/589; 123/480

[58] Field of Search ..... 123/489, 480, 587, 589, 123/490

[56] References Cited

U.S. PATENT DOCUMENTS

| | | | |
|---|---|---|---|
| 4,052,968 | 8/1975 | Hattori et al. | 123/589 |
| 4,079,711 | 3/1978 | Hattori et al. | 123/589 |
| 4,140,093 | 2/1979 | Hattori et al. | 123/589 |
| 4,237,838 | 12/1980 | Kinugawa et al. | 123/587 |
| 4,248,196 | 2/1981 | Toelle | 123/489 |
| 4,354,238 | 10/1982 | Manaka et al. | 123/480 |

*Primary Examiner*—Parshotam S. Lall

*Attorney, Agent, or Firm*—Cushman, Darby & Cushman

[57] ABSTRACT

An air-fuel ratio control system for engines comprises a control unit by which the air-fuel ratio is maintained constant to enrich the mixture gas for a first predetermined time length after the detection of an engine heavy load condition, the air-fuel ratio is controlled as predetermined on the basis of an oxygen detection signal for a second predetermined time length after the lapse of the first predetermined time length, and the air-fuel ratio is restored to the constant value thereby to enrich the mixture gas after the lapse of the second predetermined time length.

4 Claims, 7 Drawing Figures

AIR-FUEL RATIO CONTROL SYSTEM FOR INTERNAL COMBUSTION ENGINES

BACKGROUND OF THE INVENTION

The present invention relates to an air-fuel ratio control system for automotive vehicles, or more in particular to an air-fuel ratio control system intended to improve the running performance of the automotive engine under heavy load.

Conventionally, under the heavy load conditions with the throttle fully open, the air-fuel ratio is controlled by feedback for a predetermined length of time (say, four seconds) following the full opening of the throttle and then the feedback loop is opened thereby to stop the air-fuel ratio control. In this conventional air-fuel ratio control, even though the throttle is opened full for acceleration, a sufficiently rich mixture gas is not obtained since the air-fuel ratio is being controlled, thus posing the problem of acceleration.

SUMMARY OF THE INVENTION

The object of the present invention is to obviate the above-mentioned disadvantage of the prior art systems. Generally, a rich mixture gas is required for acceleration under heavy loads. For this purpose, the feedback control should preferably be stopped. If the feedback control continues to be suspended over the period of the heavy load conditions, however, the mixture gas becomes rich so that CO and HC components of the exhaust gas increase. The feature of the present invention resides in that the feedback control is resumed for an appropriate length of time during the period of heavy load conditions, thus solving the problem of the increased CO and HC.

According to the present invention, there is provided an air-fuel ratio control system comprising a plurality of timer circuits, in which the feedback control signal is cut off instantaneously immediately after the heavy load phase is entered so that the air-fuel ratio control is suspended to improve the acceleration performance, and after that, the feedback loop is closed to resume the air-fuel ratio control. In this way, the problem of the increased CO and HC components of the exhaust gas is solved, followed by opening the feedback loop again for suspension of the air-fuel ratio control.

DESCRIPTION OF THE PREFERRED EMBODIMENTS

Figure 1:
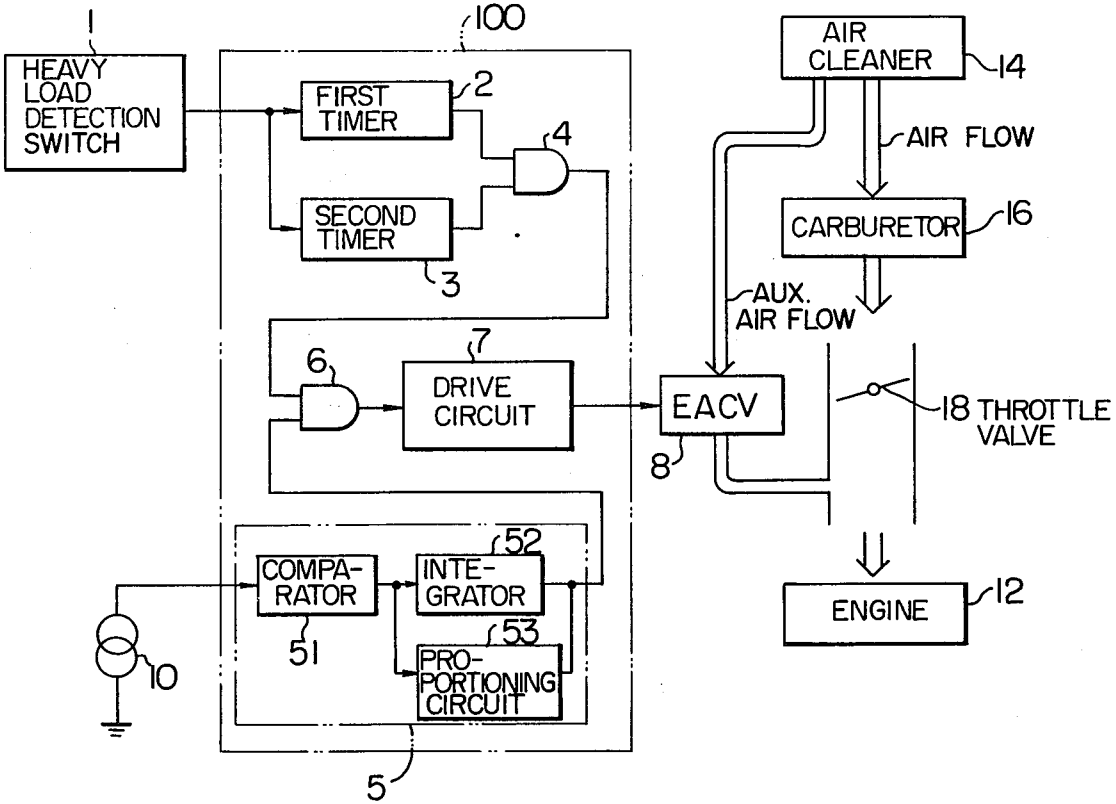
FIG. 1 is a block diagram showing a first embodiment of the system according to the present invention.

A block diagram for explaining a circuit configuration of the present invention is shown in FIG. 1. In FIG. 1, reference numeral 1 designates a heavy load detector switch closed under normal load. Numeral 2 designates a first timer circuit, numeral 3 a second timer circuit, numeral 4 a first AND gate, numeral 5 a control circuit, numeral 6 a second AND gate, numeral 7 a drive circuit, and numeral 8 an air-fuel ratio control means (EACV).

EACV 8 is a valve of linear solenoid type for controlling the air flow rate and regulates the air-fuel ratio of the mixture gas by adjusting the auxiliary air flow supplied bypassing a carburetor 16 and a throttle valve 18.

An oxygen sensor 10 is provided in the exhaust pipe of the engine for detecting the air-fuel ratio from the oxygen concentration of the exhaust gas, and is of a well-known zirconia or titanium type.

An automotive engine 12 is of a well-known spark ignition type, in which the combustion air is sucked through an air cleaner 14, the carburetor 16, the throttle valve 18, and the fuel is mixed with the air in the carburetor 16 thereby to introduce an air-fuel mixture.

Figure 2:
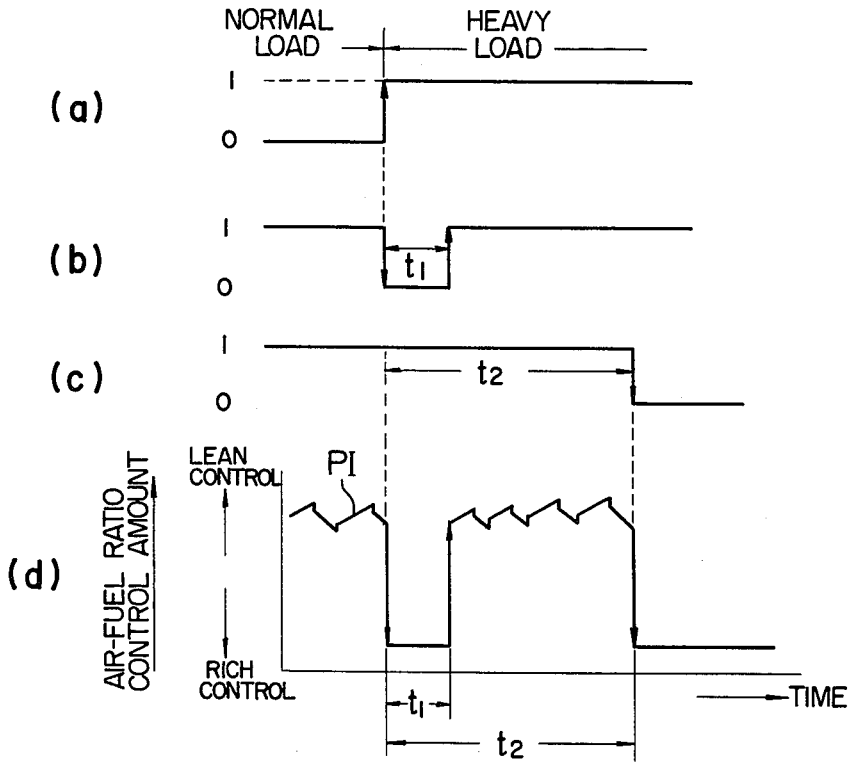
FIG. 2 shows signal waveforms for explaining the operation of the system of FIG. 1.

An air-fuel ratio control circuit 5 includes a comparator 51 for comparing a signal from the oxygen sensor 10 with a set value, an integration control means 52 and a proportion control means for performing the integration and proportion of the output of the comparator 51 respectively, thus producing an output signal of the waveform as shown by PI in FIG. 2(*d*).

The first timer 2, which produces a "1" signal under normal conditions as shown in FIG. 2(*b*), produces a "0" signal when a heavy load condition is detected by a heavy load switch 1. The first timer 2 produces a "1" signal again after the lapse of the time $t_1$.

The second timer 3, on the other hand, which produces a "1" signal under normal conditions, produces a "0" signal after the lapse of time $t_2$ following the detection of a heavy load condition by the heavy load switch 1. When the heavy load switch 1 is turned off, the second timer 3 is returned to "1" level again.

The devices 2 to 7 are formed on the same printed board and make up an electronic control unit ECU 100.

Now, the operation of the circuit shown in FIG. 1 will be described with reference to FIG. 2. A vacuum switch is used in proximity to the throttle valve as the heavy load detection switch 1 thereby to detect whether the engine is under a heavy load condition or not. Under a heavy load condition, the heavy load detection switch 1 is opened and therefore the first timer circuit 2 opens the feedback loop during the predetermined time $t_1$ (say, about one second) unlike in the conventional control systems, so that the mixture gas is temporarily increased in concentration, thereby improving the acceleration performance and hence, the running performance. For a predetermined time $t_2$ (say, about three seconds) thereafter, the air-fuel ratio is controlled by feedback, followed by opening the feedback loop again.

As obvious from FIGS. 2 shown for explaining the operation, FIG. 2(*a*) illustrates the potential level of the output terminal of the heavy load detection switch 1 in closed state. Under normal load conditions where the switch 1 is closed, the potential level of the output terminal thereof is at low level (namely, "0"). Under a heavy load condition where the switch 1 opens, by contrast, the potential level of the output terminal is at high level (namely, "1"). Thus, immediately after a heavy load condition is detected by the heavy load detection switch 1, the first timer circuit 2 is opened, so that the output signal of the first timer circuit 2 is reduced to a logic "0": and the first and second AND gates are closed for the time $t_1$. As a result, the control signal to be supplied to the drive circuit 7 through the control circuit 5 is cut off, so that the air-fuel control operation is suspended thereby to enrich the mixture gas temporarily. After the lapse of $t_1$ seconds, the output signal of the first timer circuit 2 is raised to a logic "1", and the open condition of the feedback loop is cancelled thereby to resume the air-fuel ratio control. After the lapse of time $t_2$ following the instant when a heavy load condition is reached, the output signal of the second timer circuit 3 is reduced to a logic "0", so that the first and second AND gates are closed. After that, the feedback control signal is cut off, with the result that the air-fuel ratio control is stopped.

Figure 3:
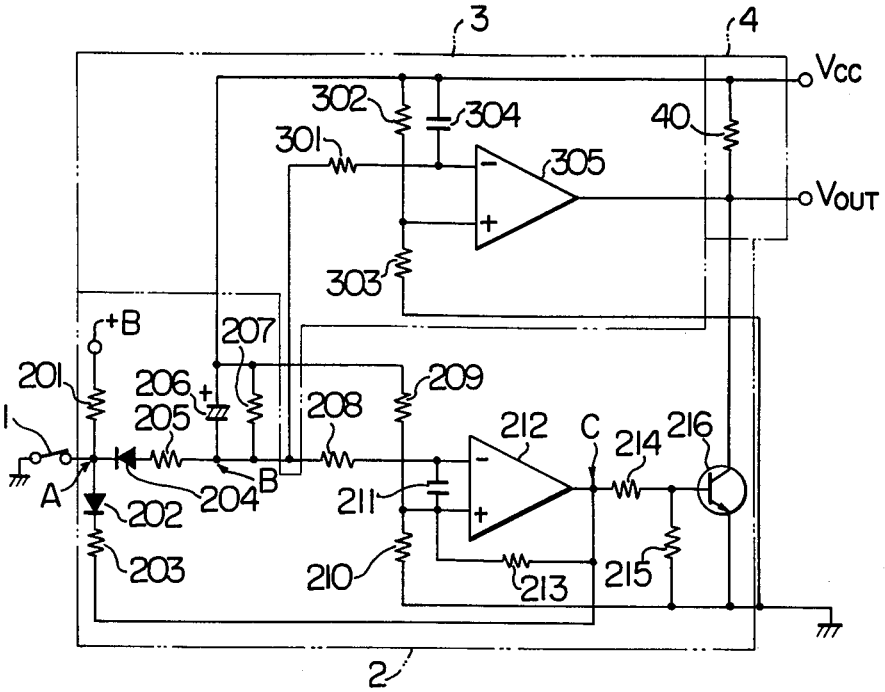
FIG. 3 is an electrical circuit diagram showing first and second timer circuits of the system shown in FIG. 1.

An electrical circuit diagram of the first and second timer circuits according to the present invention is shown in FIG. 3. A normal load condition is involved, and the output $V_{OUT}$ of the first AND gate 4 is maintained at logic "1". The circuit operation of this case will be explained. A capacitor 206 is charged at the polarity shown in FIG. 3 by the current due to a source output voltage $V_{CC}$, flowing in a charge circuit grounded through the capacitor 206, a resistor 205, a diode 204 and a heavy load switch 1. Since the resistance value of the resistor 206 is very low, the voltage at point B of FIG. 3 is lower than the reference voltage determined by resistors 209 and 210 and therefore the comparator 212 produces a "1" output voltage. The comparator 212 is of open collector type and produces a very low voltage, which is further divided by the resistors 214 and 215 and applied to the base of the transistor 216. At a voltage applied to the base under normal load conditions, therefore, the transistor 216 is maintained non-conducting, and the collector potential of the transistor 216 is substantially equal to the output voltage $V_{CC}$ of the voltage source.

Figure 4:
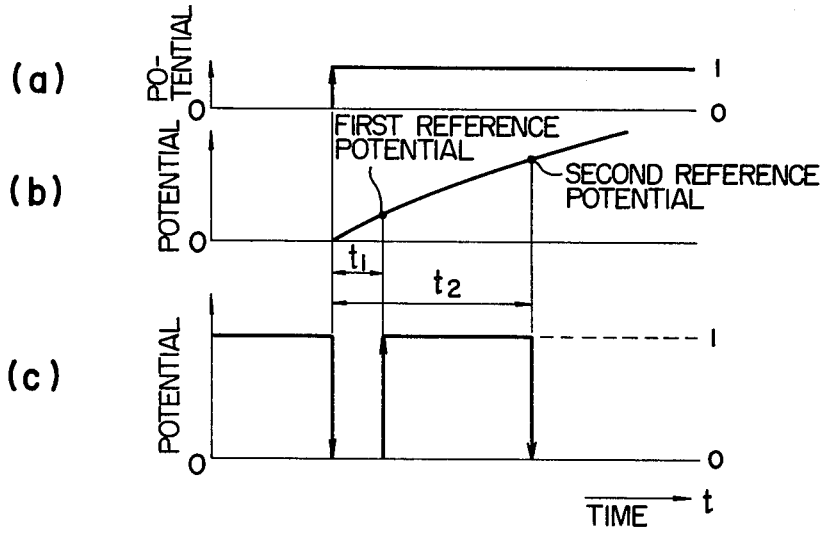
FIG. 4 shows signal waveforms for explaining the operation of the timer circuits of FIG. 3.

The instant the engine enters a heavy load condition, the heavy load switch 1 opens, and the output voltage of the bias power supply +B is superposed on the base voltage through the diode 202 and the resistor 203. The transistor 216 is thus turned on so that the collector potential of the transistor 216 is reduced substantially to "0". The positive input terminal of the comparator 305 making up the second timer circuit is impressed with a second reference potential obtained by dividing the output voltage of the voltage source $V_{CC}$ by the resistors 302 and 303, and the output terminal of the comparator 305 is "1" in potential. Since the potential of the output terminal of the first timer circuit that is the collector potential of the transistor 216 is "0", the potential at the output terminal of the first AND gate 4 is "0". From the instant when the heavy load switch 1 is opened, the capacitor 206 begins to discharge through the resistor 207, so that the potential at point B increases as shown in FIG. 4(*b*). When the potential at point B increases to the first reference potential, the transistor 216 is cut off again, and the collector potential thereof is raised to "1". Thus, as shown in FIG. 4(*c*), the output $V_{OUT}$ of the first AND gate 4 is raised to "1". The capacitor 206 further discharges, and when the potential at point B reaches the second reference potential, the potential at the output terminal of the comparator 305 is reduced to "0", so that the potential at the output terminal of the first AND gate is also reduced to "0" as shown in FIG. 4(*c*). As seen from the above description, according to the present invention, the feedback loop is opened for the time $t_1$ by the pair of timer circuits the very instant a heavy load condition is reached, thereby increasing the concentration of the mixture gas, with the result that the running performance is improved under heavy load conditions.

Figure 5:
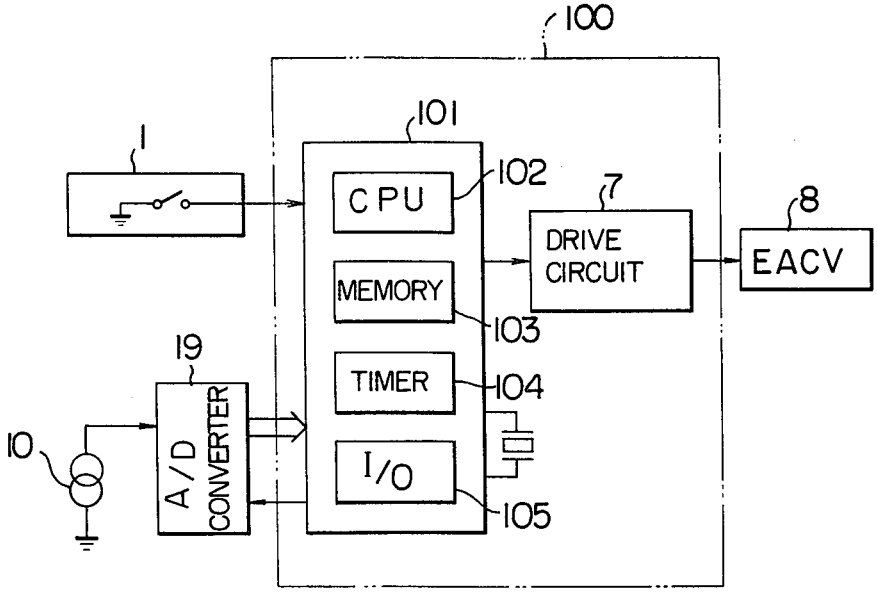
FIG. 5 is a block diagram showing a second embodiment of the system according to the present invention.
Figure 7:
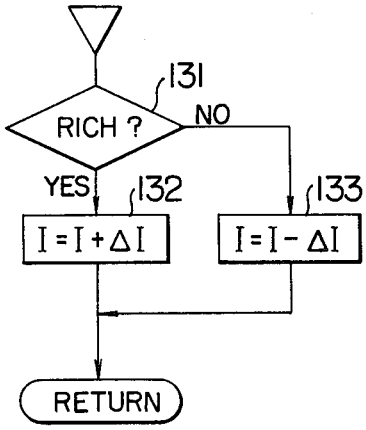
FIG. 7 is a flowchart for explaining the operation of the system shown in FIG. 5.
Figure 6:
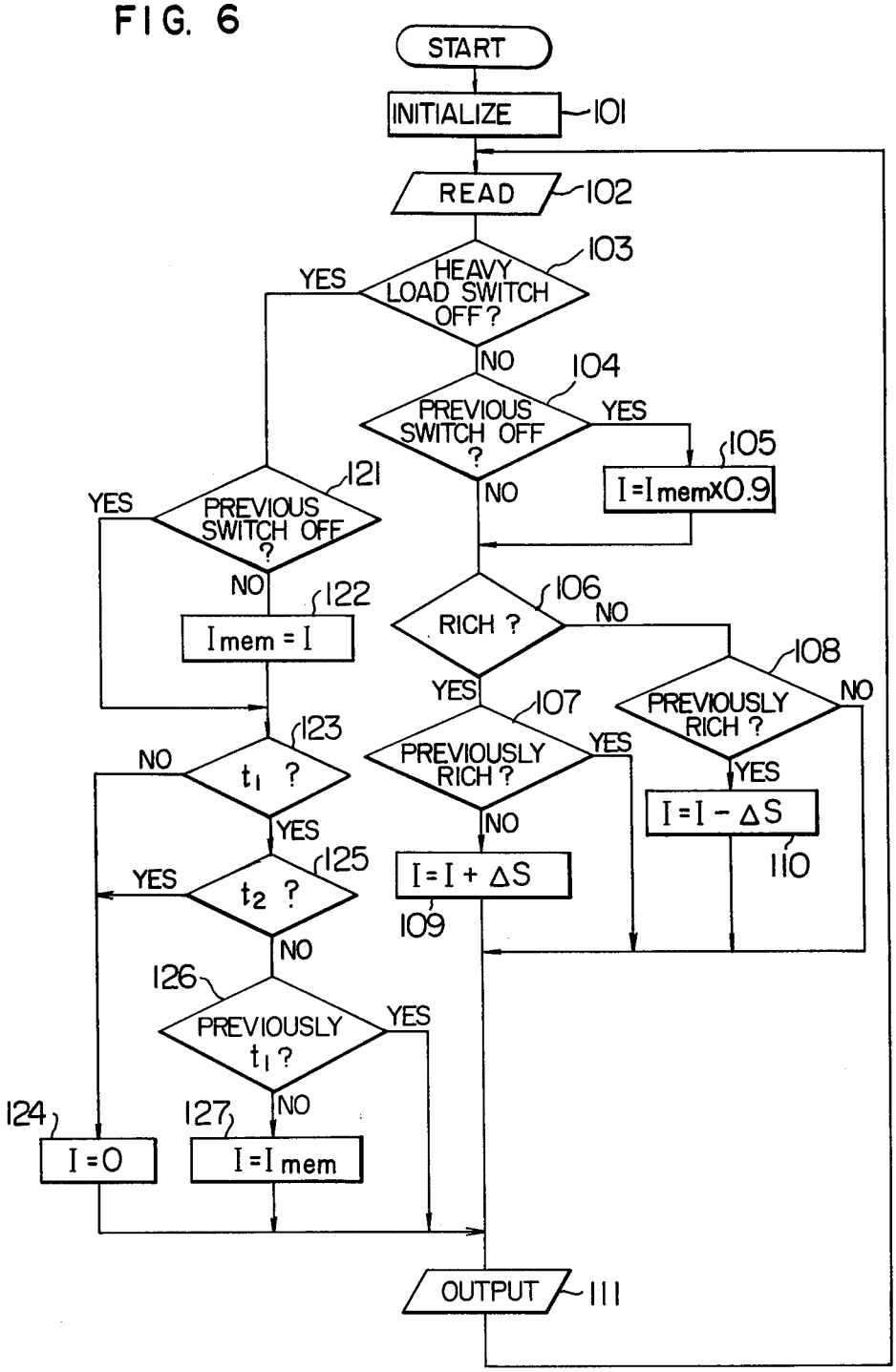
FIG. 6 is a flowchart for explaining the operation of the system shown in FIG. 5.

Another embodiment of the present invention using a microcomputer is shown in FIGS. 5 to 7.

The ECU 100 is comprised of a microcomputer 101 such as 68 Series of Motorola, 80 Series of Intel or other well-known device, and includes a CPU 102, a memory 103 such as ROM or RAM, a timer 104 and an input-/output unit 105.

The microcomputer 101 produces a drive signal for controlling the EACV 8 in response to signals from the heavy load switch 1 and the oxygen sensor 10, which drive signal is applied to the drive circuit 7. The signal of the sensor 10 takes a digital form produced from the A/D converter 19.

The microcomputer 101 operates according to the main routine of FIG. 6 and the 4-msec timer routine of FIG. 7. Specifically, the operation is started from the initialization step 101, followed by the step 102 for reading the A/D converted value of the oxygen sensor 10 and the output of the heavy load switch 1.

Step 103 decides whether or not the heavy load detection switch 1 is turned off, namely, whether or not a heavy load condition is involved, and if a normal load condition is involved, the answer is "No", so that the process proceeds to step 104. Step 104 decides whether or not the heavy load detection switch 1 is turned off in the preceding program cycle, and the load condition is normal, the answer is "No" so that the process is passed to step 106.

At step 106, it is decided whether or not the output value of the oxygen sensor 10 indicates a rich condition in terms of the air-fuel ratio, and if the answer is "Yes", the process proceeds to step 107, while if the answer is "No", the process is passed to step 108. Steps 107 and 108 decide whether or not the output value of the sensor 10 indicates a rich condition in the preceding program cycle for detecting whether the signal of the sensor 10 has changed from lean to rich or rich to lean during the time of proceeding from the preceding program cycle to the present program cycle.

In the case where the above-mentioned change has occurred, the skip value $\Delta S$ is added to or subtracted from the integration value I at step 109 or 110 respectively, while if the change has not occurred, the process is passed directly to step 111. Step 111 applies a drive signal corresponding to the integration value I to the circuit 8, so that one program cycle is completed and the next program cycle starts from the step 102.

Under normal conditions, these steps are repeated and during this period, the timer interruption routine shown in FIG. 7 is started to perform a digital integration at intervals of 4 msec.

Specifically, it is decided whether or not the output of the sensor 10 is in rich state at the step 131, and if the rich condition is involved, the answer is "Yes", so that the minute value $\Delta I$ is added to the integration value I, while if the lean condition is involved, the answer is "No" and the minute value $\Delta I$ is subtracted from the integration value I.

By adding $\Delta I$ to or subtracting it from the integration value at intervals of 4 msec in this way, a substantially digital integration is effected, and a signal based on the integration and skip (proportion) is produced at the step 111 of the main routine.

When a heavy load condition is entered, step 103 decides that the answer is "Yes", followed by the step 121 for deciding whether or not the heavy load switch is turned off also in the preceding cycle, that is, whether or not the heavy load condition is entered for the first time.

If a heavy load condition is entered for the first time, step 122 stores the integration value I in the variable Imem while if the answer is reverse, the process proceeds directly to step 123. Step 123 decides whether or not the time $t_1$ has passed since the heavy load condition is entered, and if the time $t_1$ is not passed, the integration value I is set to zero for closing up the EACV 8 at the step 124.

If the time $t_1$ has passed, on the other hand, the process is passed to step 125. If the time $t_2$ has passed, the process proceeds from step 125 to step 124. If the time $t_2$ has not passed, in contrast, the process is passed to step 126 for deciding whether or not the time $t_1$ passed in the preceding program cycle. In other words, only if the step 126 is reached for the first time after the lapse of time $t_1$, the value Imem stored at step 122 is made I at step 127. Otherwise, the process proceeds directly to step 111.

When the heavy load detection switch 1 is turned from off to on, the answer at step 104 is "Yes", and the step 105 changes the value I to a value representing 90% of Imem stored at step 122.

We claim:

1. An air-fuel ratio control system for an engine, comprising:

an oxygen sensor for detecting an air-fuel ratio of said engine;

heavy load detector means for detecting a heavy load condition of the engine;

an electric actuator for regulating the air-fuel ratio; and an electronic control unit for applying a drive signal to said electric actuator in response to signals from said oxygen sensor and said heavy load detector means;

said control unit including means, responsive to the signal of said heavy load detector, for detecting the lapse of a first time interval beginning from a time when the heavy load condition is detected and the lapse of a second time interval beginning from the time when the heavy load condition is detected, means for generating the drive signal to enrich the air-fuel ratio regardless of the signal of said oxygen sensor before the lapse of the first time interval, means response to the signal of said oxygen sensor, for generating the drive signal to regulate the air-fuel ratio from the time when the first time interval is lapsed to the time when the second time interval is lapsed, and means for generating the drive signal for enriching the air-fuel ratio regardless of the signal from said oxygen sensor after the lapse of said second time interval.

2. A system according to claim 1, wherein said control unit includes a first timer circuit for detecting that said first time interval has passed since the detection of a heavy load condition of the engine by said heavy load detector means, a second timer circuit for detecting that said second time interval has passed since the detection of a heavy load condition of the engine by said heavy load detector means, a first AND circuit for combining the outputs of said first and second timer circuits, an air-fuel ratio control circuit for comparing the output signal of said oxygen sensor and proportioning and integrating the resulting comparison signal, a second AND circuit for combining the output of said first AND circuit and the output of said air-fuel ratio control circuit, and a drive circuit for driving said actuator in response to the output signal of said second AND circuit.

3. A system according to claim 1, wherein said control unit includes a microcomputer, said microcomputer including:

first means for deciding whether said heavy load detector means has detected a heavy load condition of the engine;

second means for deciding whether said heavy load detector means has detected a heavy load condition of the engine in the preceding program cycle;

third means for deciding whether a heavy load condition of the engine detected by said heavy load detector means has continued for longer than said first time interval;

fourth means for deciding whether said heavy load condition has continued for longer than said second time interval if said heavy load condition has continued for longer than said first time interval; and fifth means for deciding whether said heavy load condition continued for longer than said first time interval in the preceding program cycle if said heavy load condition has not continued for longer than said second time interval.

4. In an air-fuel ratio control system for engines, comprising air-fuel ratio control means, a circuit for driving said air-fuel ratio control means and a control circuit for controlling said drive circuit, said air-fuel ratio control means being subjected to feedback control; the improvement further comprising:

a heavy load detection switch providing a detection signal when a heavy load condition exists, a first timer circuit for producing an output of a first predetermined logic value in response to the detection signal, said output being restored to a second predetermined logic value after the lapse of a first predetermined time interval from the time when the heavy load condition is detected, a second timer circuit for producing an output of said first predetermined logic value after the lapse of a second predetermined time interval from the time when the heavy load condition is detected in response to said load detection signal, a first gate circuit for producing the logic product of the outputs of said first timer circuit and said second timer circuit, and a second gate circuit for applying the logic product of the outputs of said first gate circuit and said control circuit to said drive circuit.

* * * * *